US012320587B2

(12) United States Patent
Mak

(10) Patent No.: US 12,320,587 B2
(45) Date of Patent: Jun. 3, 2025

(54) PHASE IMPLEMENTATION OF NATURAL GAS LIQUID RECOVERY PLANTS

(71) Applicant: Fluor Technologies Corporation, Irving, TX (US)

(72) Inventor: John Mak, Santa Ana, CA (US)

(73) Assignee: Fluor Technologies Corporation, Irving, TX (US)

( * ) Notice: Subject to any disclaimer, the term of this patent is extended or adjusted under 35 U.S.C. 154(b) by 0 days.

(21) Appl. No.: 17/393,477

(22) Filed: Aug. 4, 2021

(65) Prior Publication Data

US 2021/0381760 A1 Dec. 9, 2021

Related U.S. Application Data

(62) Division of application No. 15/789,463, filed on Oct. 20, 2017, now Pat. No. 11,112,175.

(51) Int. Cl.
*F25J 3/02* (2006.01)

(52) U.S. Cl.
CPC ..... *F25J 3/0238* (2013.01); *F25J 3/0209* (2013.01); *F25J 3/0233* (2013.01); *F25J 3/0242* (2013.01);
(Continued)

(58) Field of Classification Search
CPC ..... F25J 3/0209; F25J 3/0238; F25J 3/0242; F25J 2200/04; F25J 2215/62; F25J 2215/64; C07C 7/04
(Continued)

(56) References Cited

U.S. PATENT DOCUMENTS 2,603,310 A 7/1952 Gilmore
2,771,149 A 11/1956 Miller
(Continued)

FOREIGN PATENT DOCUMENTS

AR 0103703 5/2017
AR 115412 A1 1/2021
(Continued)

OTHER PUBLICATIONS

Office Action dated Dec. 29, 2021, Saudi Arabian Patent Application No. 51891931 filed Jan. 15, 2016.
(Continued)

*Primary Examiner* — John F Pettitt, III
(74) *Attorney, Agent, or Firm* — Andrew M. Metrailer; Ryan D. Jenlink; Conley Rose, P.C.

(57) ABSTRACT

Embodiments relate generally to systems and methods for operating a natural gas liquids plant in ethane rejection and in ethane recovery. A natural gas liquid plant may comprise an absorber configured to produce an ethane rich bottom stream and an ethane depleted vapor stream; a stripper fluidly coupled to the absorber configured to, during ethane rejection, fractionate the ethane rich bottom stream from the absorber into an ethane overhead product and a propane plus hydrocarbons product, and configured to, during ethane recovery, fractionate the ethane rich bottom stream into an ethane plus NGL stream and an overhead vapor stream; and an exchanger configured to, during ethane recovery, counter-currently contact the ethane rich bottom stream from the absorber with the ethane depleted vapor stream from the absorber, thereby heating the vapor stream and chilling the ethane rich bottom stream before the ethane rich bottom stream is fed to the stripper.

9 Claims, 4 Drawing Sheets

(52) U.S. Cl.
CPC ..... *F25J 2200/04* (2013.01); *F25J 2200/70* (2013.01); *F25J 2200/78* (2013.01); *F25J 2205/04* (2013.01); *F25J 2205/50* (2013.01); *F25J 2210/06* (2013.01); *F25J 2215/04* (2013.01); *F25J 2215/62* (2013.01); *F25J 2215/64* (2013.01); *F25J 2240/02* (2013.01); *F25J 2240/40* (2013.01); *F25J 2270/02* (2013.01); *F25J 2270/08* (2013.01); *F25J 2270/12* (2013.01); *F25J 2270/60* (2013.01); *F25J 2280/02* (2013.01)

(58) Field of Classification Search
USPC ..... 62/630
See application file for complete search history.

(56) References Cited

U.S. PATENT DOCUMENTS 3,320,754 A 5/1967 Tucker
3,421,610 A 1/1969 Marshall
3,421,984 A 1/1969 Jensen
3,793,157 A 2/1974 Hobbs et al.
4,004,430 A 1/1977 Solomon et al.
4,061,481 A 12/1977 Campbell et al.
4,102,659 A 7/1978 Martin
4,157,904 A 6/1979 Campbell
4,164,452 A 8/1979 Funk et al.
4,203,742 A 5/1980 Agnihotri
4,278,457 A 7/1981 Campbell et al.
4,453,958 A 6/1984 Gulsby et al.
4,474,591 A 10/1984 Arand et al.
4,496,380 A 1/1985 Harryman
4,507,133 A 3/1985 Khan et al.
4,509,967 A 4/1985 Sweet
4,519,824 A 5/1985 Huebel
4,617,039 A 10/1986 Buck
4,657,571 A 4/1987 Gazzi
4,676,812 A 6/1987 Kummann
4,695,349 A 9/1987 Becker et al.
4,854,955 A 8/1989 Campbell et al.
4,895,584 A 1/1990 Buck et al.
RE33,408 E 10/1990 Khan et al.
5,220,797 A 6/1993 Krishnamurthy et al.
5,291,736 A 3/1994 Paradowski
5,462,583 A 10/1995 Wood et al.
5,555,748 A 9/1996 Campbell et al.
5,657,643 A 8/1997 Price
5,669,238 A 9/1997 Devers
5,685,170 A 11/1997 Sorensen
5,687,584 A 11/1997 Mehra
5,746,066 A 5/1998 Manley
5,771,712 A 6/1998 Campbell et al.
5,881,569 A 3/1999 Campbell et al.
5,890,377 A 4/1999 Foglietta
5,890,378 A 4/1999 Rambo et al.
5,953,935 A 9/1999 Sorensen
5,983,664 A 11/1999 Campbell et al.
5,992,175 A 11/1999 Yao et al.
6,006,546 A 12/1999 Espie
6,112,549 A 9/2000 Yao et al.
6,116,050 A 9/2000 Yao et al.
6,116,051 A 9/2000 Agrawal et al.
6,125,653 A 10/2000 Shu et al.
6,182,469 B1 2/2001 Campbell et al.
6,244,070 B1 6/2001 Lee et al.
6,308,532 B1 10/2001 Hopewell
6,311,516 B1 11/2001 Key et al.
6,336,344 B1 1/2002 OBrien
6,354,105 B1 3/2002 Lee et al.
6,363,744 B2 4/2002 Finn et al.
6,368,385 B1 4/2002 Paradowski
6,401,486 B1 6/2002 Lee et al.
6,405,561 B1 6/2002 Mortko et al.
6,453,698 B2 9/2002 Jain et al.
6,516,631 B1 2/2003 Trebble
6,601,406 B1 8/2003 Deng et al.
6,658,893 B1 12/2003 Mealey
6,712,880 B2 3/2004 Foglietta et al.
6,755,965 B2 6/2004 Pironti et al.
6,823,692 B1 11/2004 Patel et al.
6,837,070 B2 1/2005 Mak
6,915,662 B2 7/2005 Wilkinson et al.
7,051,552 B2 5/2006 Mak
7,051,553 B2 5/2006 Mak et al.
7,069,744 B2 7/2006 Patel et al.
7,073,350 B2 7/2006 Mak
7,107,788 B2 9/2006 Patel et al.
7,159,417 B2 1/2007 Foglietta et al.
7,192,468 B2 3/2007 Mak et al.
7,216,507 B2 5/2007 Cuellar et al.
7,219,513 B1 5/2007 Mostafa
7,377,127 B2 5/2008 Mak
7,424,808 B2 9/2008 Mak
7,437,891 B2 10/2008 Reyneke et al.
7,574,856 B2 8/2009 Mak
7,597,746 B2 10/2009 Mak et al.
7,600,396 B2 10/2009 Mak
7,635,408 B2 12/2009 Mak et al.
7,637,987 B2 12/2009 Mak
7,674,444 B2 3/2010 Mak
7,713,497 B2 5/2010 Mak
7,856,847 B2 12/2010 Patel et al.
7,856,848 B2 12/2010 Lu
8,110,023 B2 2/2012 Mak et al.
8,117,852 B2 2/2012 Mak
8,142,648 B2 3/2012 Mak
8,147,787 B2 4/2012 Mak et al.
8,192,588 B2 6/2012 Mak
8,196,413 B2 6/2012 Mak
8,209,996 B2 7/2012 Mak
8,316,665 B2 11/2012 Mak
8,377,403 B2 2/2013 Mak
8,398,748 B2 3/2013 Mak
8,434,325 B2 5/2013 Martinez et al.
8,480,982 B2 7/2013 Mak
8,505,312 B2 8/2013 Mak et al.
8,528,361 B2 9/2013 Nanda et al.
8,567,213 B2 10/2013 Mak
8,635,885 B2 1/2014 Mak
8,661,820 B2 3/2014 Mak
8,677,780 B2 3/2014 Mak
8,695,376 B2 4/2014 Mak
8,696,798 B2 4/2014 Mak
8,840,707 B2 9/2014 Mak
8,845,788 B2 9/2014 Mak
8,850,849 B2 10/2014 Martinez et al.
8,876,951 B2 11/2014 Mak
8,893,515 B2 11/2014 Mak
8,910,495 B2 12/2014 Mak
8,919,148 B2 12/2014 Wilkinson et al.
8,950,196 B2 2/2015 Mak
9,103,585 B2 8/2015 Mak
9,114,351 B2 8/2015 Mak
9,132,379 B2 9/2015 Mak
9,248,398 B2 2/2016 Mak
9,423,175 B2 8/2016 Mak
9,557,103 B2 1/2017 Mak
9,631,864 B2 4/2017 Chen et al.
10,006,701 B2 6/2018 Mak
10,077,938 B2 9/2018 Mak
10,330,382 B2 6/2019 Mak et al.
10,451,344 B2 10/2019 Mak
10,704,832 B2 7/2020 Mak
10,760,851 B2 9/2020 Thiebault et al.
11,112,175 B2 9/2021 Mak
11,365,933 B2 6/2022 Mak et al.
11,725,879 B2 8/2023 Mak
2002/0042550 A1 4/2002 Pironti et al.
2002/0157538 A1 10/2002 Foglietta et al.
2003/0005722 A1 1/2003 Wilkinson
2003/0089126 A1 5/2003 Stringer
2004/0079107 A1 4/2004 Wilkinson et al.
2004/0148964 A1 8/2004 Patel et al.
2004/0159122 A1 8/2004 Patel et al.

(56) References Cited

U.S. PATENT DOCUMENTS

| | | | |
|---|---|---|---|
| 2004/0172967 | A1 | 9/2004 | Patel et al. |
| 2004/0206112 | A1 | 10/2004 | Mak |
| 2004/0237580 | A1 | 12/2004 | Mak |
| 2004/0250569 | A1 | 12/2004 | Mak |
| 2004/0261452 | A1 | 12/2004 | Mak et al. |
| 2005/0047995 | A1 | 3/2005 | Wylie |
| 2005/0201410 | A1 | 9/2005 | Sekine |
| 2005/0218041 | A1 | 10/2005 | Yoshida et al. |
| 2005/0247078 | A1 | 11/2005 | Wilkinson et al. |
| 2005/0255012 | A1 | 11/2005 | Mak |
| 2005/0268649 | A1 | 12/2005 | Wilkinson et al. |
| 2006/0000234 | A1 | 1/2006 | Cuellar et al. |
| 2006/0021379 | A1 | 2/2006 | Ronczy |
| 2006/0032269 | A1 | 2/2006 | Cuellar et al. |
| 2006/0221379 | A1 | 10/2006 | Noda |
| 2006/0260355 | A1 | 11/2006 | Roberts et al. |
| 2006/0277943 | A1 | 12/2006 | Yokohata et al. |
| 2006/0283207 | A1 | 12/2006 | Pitman et al. |
| 2007/0157663 | A1 | 7/2007 | Mak et al. |
| 2007/0240450 | A1 | 10/2007 | Mak |
| 2008/0016909 | A1 | 1/2008 | Lu |
| 2008/0190136 | A1 | 8/2008 | Pitman |
| 2008/0271480 | A1 | 11/2008 | Mak |
| 2009/0100862 | A1 | 4/2009 | Wilkinson et al. |
| 2009/0113931 | A1 | 5/2009 | Patel et al. |
| 2009/0277217 | A1 | 11/2009 | Ransbarger et al. |
| 2010/0000255 | A1 | 1/2010 | Mak |
| 2010/0011809 | A1 | 1/2010 | Mak |
| 2010/0011810 | A1 | 1/2010 | Mak et al. |
| 2010/0043488 | A1 | 2/2010 | Mak et al. |
| 2010/0126187 | A1 | 5/2010 | Mak |
| 2010/0206003 | A1 | 8/2010 | Mak |
| 2010/0275647 | A1 | 11/2010 | Johnke et al. |
| 2010/0287984 | A1 | 11/2010 | Johnke et al. |
| 2011/0067442 | A1 | 3/2011 | Martinez et al. |
| 2011/0067443 | A1 | 3/2011 | Martinez et al. |
| 2011/0174017 | A1 | 7/2011 | Victory et al. |
| 2011/0226014 | A1 | 9/2011 | Johnke et al. |
| 2011/0265511 | A1 | 11/2011 | Fischer et al. |
| 2012/0000245 | A1 | 1/2012 | Currence et al. |
| 2012/0036890 | A1 | 2/2012 | Kimble et al. |
| 2012/0085127 | A1 | 4/2012 | Nanda et al. |
| 2012/0096896 | A1 | 4/2012 | Patel et al. |
| 2012/0137726 | A1 | 6/2012 | Currence et al. |
| 2013/0014390 | A1 | 1/2013 | Mak |
| 2013/0061632 | A1 | 3/2013 | Brostow et al. |
| 2013/0061633 | A1 | 3/2013 | Mak et al. |
| 2013/0186133 | A1 | 7/2013 | Ploeger et al. |
| 2013/0298602 | A1 | 11/2013 | Prim |
| 2014/0013797 | A1 | 1/2014 | Butts |
| 2014/0026615 | A1 | 1/2014 | Mak |
| 2014/0060114 | A1 | 3/2014 | Mak |
| 2014/0075987 | A1 | 3/2014 | Mak |
| 2014/0182331 | A1 | 7/2014 | Burmberger et al. |
| 2014/0260420 | A1 | 9/2014 | Mak |
| 2014/0290307 | A1 | 10/2014 | Gahier et al. |
| 2014/0345319 | A1 | 11/2014 | Santos |
| 2015/0184931 | A1 | 7/2015 | Mak |
| 2015/0322350 | A1 | 11/2015 | Iyer et al. |
| 2016/0069610 | A1 | 3/2016 | Anguiano et al. |
| 2016/0231052 | A1 | 8/2016 | Mak |
| 2016/0327336 | A1 | 11/2016 | Kennedy et al. |
| 2017/0051970 | A1 | 2/2017 | Mak |
| 2017/0058708 | A1 | 3/2017 | Noureldin et al. |
| 2017/0370641 | A1 | 12/2017 | Mak et al. |
| 2018/0017319 | A1 | 1/2018 | Mak et al. |
| 2018/0058754 | A1 | 3/2018 | Lynch et al. |
| 2018/0066889 | A1 | 3/2018 | Gaskin et al. |
| 2018/0149425 | A1 | 5/2018 | Oneal et al. |
| 2018/0231305 | A1 | 8/2018 | Pierre, Jr. |
| 2018/0306498 | A1 | 10/2018 | Rovers et al. |
| 2018/0320960 | A1 | 11/2018 | Terrien et al. |
| 2018/0347899 | A1 | 12/2018 | Cuellar et al. |
| 2019/0011180 | A1 | 1/2019 | Mostafa |
| 2019/0086147 | A1 | 3/2019 | Brown et al. |
| 2019/0120550 | A1 | 4/2019 | Mak |
| 2019/0154333 | A1 | 5/2019 | Mak |
| 2019/0242645 | A1 | 8/2019 | Mak et al. |
| 2019/0271503 | A1 | 9/2019 | Terrien et al. |
| 2020/0064064 | A1 | 2/2020 | Butts |
| 2020/0072546 | A1 | 3/2020 | Thom et al. |
| 2020/0141639 | A1 | 5/2020 | Mak et al. |
| 2020/0199046 | A1 | 6/2020 | Simon et al. |
| 2020/0370824 | A1 | 11/2020 | Mak et al. |
| 2021/0095921 | A1 | 4/2021 | Mak et al. |
| 2023/0349633 | A1 | 11/2023 | Mak |

FOREIGN PATENT DOCUMENTS

| | | | |
|---|---|---|---|
| AR | 115412 | B1 | 5/2023 |
| AT | 383557 | T | 1/2010 |
| AU | 2002303849 | A1 | 12/2003 |
| AU | 2008287322 | A1 | 2/2009 |
| AU | 2011349713 | A1 | 7/2013 |
| AU | 2016407529 | A1 | 11/2018 |
| CA | 2176430 | A1 | 4/1997 |
| CA | 2484085 | A1 | 12/2003 |
| CA | 2694149 | A1 | 2/2009 |
| CA | 3084911 | A1 | 12/2012 |
| CA | 2976071 | A1 | 8/2016 |
| CA | 3008229 | | 1/2022 |
| CA | 3022085 | C | 5/2023 |
| CN | 2004800385528 | | 12/2009 |
| CN | 101815915 | A | 8/2010 |
| CN | 113795461 | | 12/2021 |
| DE | 60224585 | T2 | 4/2009 |
| EA | 007771 | B1 | 2/2007 |
| EA | 201390957 | A1 | 12/2013 |
| EP | 0010939 | A1 | 5/1980 |
| EP | 1508010 | A1 | 2/2005 |
| EP | 2185878 | A1 | 5/2010 |
| EP | 2521761 | A1 | 11/2012 |
| EP | 2655992 | A1 | 10/2013 |
| EP | 3256550 | A1 | 12/2017 |
| EP | 3400278 | A1 | 11/2018 |
| GC | 0004114 | | 4/2016 |
| JP | 2007510124 | A | 4/2007 |
| MX | 2010001472 | A | 3/2010 |
| MX | 2013007136 | A | 8/2013 |
| MX | 391995 | | 5/2022 |
| MX | 411149 | | 3/2024 |
| NO | 20044580 | L | 12/2004 |
| WO | 99023428 | A1 | 5/1999 |
| WO | 0188447 | A1 | 11/2001 |
| WO | 2002014763 | A1 | 2/2002 |
| WO | 2002079706 | A1 | 10/2002 |
| WO | 2003095913 | A1 | 11/2003 |
| WO | 2003100334 | A1 | 12/2003 |
| WO | 2004017002 | A1 | 2/2004 |
| WO | 2004065868 | A1 | 8/2004 |
| WO | 2004076946 | A2 | 9/2004 |
| WO | 2004080936 | A1 | 9/2004 |
| WO | 2005045338 | A1 | 5/2005 |
| WO | 2007001669 | A2 | 1/2007 |
| WO | 2007014069 | A2 | 2/2007 |
| WO | 2007014209 | A2 | 2/2007 |
| WO | 2008002592 | A2 | 1/2008 |
| WO | 2009023252 | A1 | 2/2009 |
| WO | 2011123278 | A1 | 10/2011 |
| WO | 2012087740 | A1 | 6/2012 |
| WO | 2012177749 | A2 | 12/2012 |
| WO | 2014047464 | A1 | 3/2014 |
| WO | 2014151908 | A1 | 9/2014 |
| WO | 2016130574 | A1 | 8/2016 |
| WO | 2017119913 | A1 | 7/2017 |
| WO | 2017200557 | A1 | 11/2017 |
| WO | 2018049128 | A1 | 3/2018 |
| WO | 2019078892 | A1 | 4/2019 |

(56) References Cited

FOREIGN PATENT DOCUMENTS

WO 2019226156 A1 11/2019
WO 20200123814 6/2020

OTHER PUBLICATIONS

Final Office Action dated Apr. 20, 2022, U.S. Appl. No. 16/260,288, filed Jan. 29, 2019.
Advisory Action dated Jul. 27, 2022, U.S. Appl. No. 16/260,288, filed Jan. 29, 2019.
Office Action dated Dec. 13, 2021, Australian Patent Application filed May 18, 2016.
Notice of Allowance dated Feb. 24, 2022, U.S. Appl. No. 16/390,687, filed Apr. 22, 2019.
Notice of Allowance dated Mar. 7, 2022, Mexican Patent Application No. MX/a/2016/009162 filed Jul. 13, 2016.
Office Action dated Dec. 21, 2021, Brazilian Patent Application filed Sep. 8, 2017.
Office Action dated Jun. 7, 2022, Brazilian Patent Application filed Sep. 8, 2017.
Office Action dated Mar. 16, 2022, U.S. Appl. No. 16/325,696, filed Feb. 14, 2019.
Final Office Action dated Jul. 5, 2022, U.S. Appl. No. 16/325,696, filed Feb. 14, 2019.
Office Action dated Jun. 20, 2022, Saudi Arabia Patent Application No. 520411793 filed Oct. 20, 2017.
Examiner's Answer to Appeal Brief dated Jun. 2, 2022, U.S. Appl. No. 16/219,126, filed Dec. 13, 2018.
Office Action dated Mar. 11, 2022, U.S. Appl. No. 16/421,138, filed May 23, 2019.
Final Office Action dated Jun. 17, 2022, U.S. Appl. No. 16/421,138, filed May 23, 2019.
Notice of Allowance dated Jan. 24, 2019, U.S. Appl. No. 15/158,143, filed May 16, 2016.
Office Action dated Aug. 11, 2017, U.S. Appl. No. 15/191,251, filed Jun. 23, 2016.
Final Office Action dated Feb. 1, 2018, U.S. Appl. No. 15/191,251, filed Jun. 23, 2016.
Advisory Action dated Apr. 23, 2018, U.S. Appl. No. 15/191,251, filed Jun. 23, 2016.
Office Action dated Aug. 15, 2018, U.S. Appl. No. 15/191,251, filed Jun. 23, 2016.
Final Office Action dated Mar. 6, 2019, U.S. Appl. No. 15/191,251, filed Jun. 23, 2016.
Restriction Requirement dated Sep. 18, 2019, U.S. Appl. No. 15/789,463, filed Oct. 20, 2017.
Office Action dated May 4, 2020, U.S. Appl. No. 15/789,463, filed Oct. 20, 2017.
Notice of Allowance dated Apr. 27, 2021, U.S. Appl. No. 15/789,463, filed Oct. 20, 2017.
Office Action dated Sep. 22, 2020, U.S. Appl. No. 16/219,126, filed Dec. 13, 2018.
Office Action dated Jan. 29, 2021, U.S. Appl. No. 16/219,126, filed Dec. 13, 2018.
Final Office Action dated Aug. 9, 2021, U.S. Appl. No. 16/219,126, filed Dec. 13, 2018.
Foreign Communication from a Related Counterpart—International Search Report and Written Opinion, dated Aug. 24, 2016, PCT/US2016/013687, filed on Jan. 15, 2016.
Foreign Communication from a Related Counterpart—International Preliminary Examination Report, dated Jul. 19, 2018, PCT/US2016/013687, filed on Jan. 15, 2016.
International Application No. PCT/US02/16311, International Preliminary Examination Report, mailed Feb. 19, 2003, 6 pages.
Foreign Communication from a Related Counterpart—International Search Report and Written Opinion, dated Feb. 16, 2005, PCT/US2004/032788, filed on Oct. 5, 2004.
Foreign Communication from a Related Counterpart—International Preliminary Report on Patentability, dated Feb. 27, 2006, PCT/US2004/032788, filed on Oct. 5, 2004.
International Application No. PCT/US08/09736, Written Opinion of the International Searching Authority, mailed Nov. 3, 2008, 5 pages.
International Application No. PCT/US08/09736, International Preliminary Report on Patentability, mailed May 25, 2010, 6 pages.
Foreign Communication from a Related Counterpart—International Search Report and Written Opinion, dated Apr. 18, 2012, PCT/2011/065140, filed on Dec. 15, 2011.
Foreign Communication from a Related Counterpart—International Preliminary Report on Patentability, dated Jun. 25, 2013, PCT/2011/065140, filed on Dec. 15, 2011.
Foreign Communication from a Related Counterpart—International Search Report and Written Opinion, dated Jul. 21, 2013, PCT/US2012/043332, filed Jun. 20, 2012.
Foreign Communication from a Related Counterpart—International Preliminary Report on Patentability, dated Jan. 4, 2015, PCT/US2012/043332, filed Jun. 20, 2012.
Foreign Communication from a Related Counterpart—International Search Report and Written Opinion, dated Jan. 14, 2014, PCT/US2013/060971, filed Sep. 20, 2013.
Foreign Communication from a Related Counterpart—International Preliminary Report on Patentability, dated Jan. 7, 2015, PCT/US2013/060971, filed Sep. 20, 2013.
Foreign Communication from a Related Counterpart—International Search Report and Written Opinion, dated Jul. 7, 2014, PCT/US2014/026655, filed on Mar. 14, 2014.
Foreign Communication from a Related Counterpart—International Preliminary Report on Patentability, dated Sep. 15, 2015, PCT/US2014/026655, filed on Mar. 14, 2014.
Foreign Communication from a Related Counterpart—International Search Report and Written Opinion, dated Jul. 1, 2016, PCT/US2016/017190, filed Feb. 6, 2016.
Foreign Communication from a Related Counterpart—International Preliminary Report on Patentability, dated Aug. 24, 2017, PCT/US2016/017190, filed Feb. 6, 2016.
Foreign Communication from a Related Counterpart—International Search Report and Written Opinion, dated Dec. 8, 2016, PCT/US2016/034362, filed on May 26, 2016.
International Search Report and Written Opinion, dated Dec. 12, 2017, PCT/US2017/0050636, filed on Sep. 8, 2017.
International Preliminary Report on Patentability, dated Mar. 21, 2019, PCT/US2017/0050636, filed on Sep. 8, 2017.
International Preliminary Report On Patentability, dated Nov. 29, 2018, PCT/US2016/034362, filed on May 26, 2016.
Foreign Communication from a Related Counterpart—International Search Report and Written Opinion, dated May 1, 2018, PCT/US2017/057674, filed on Oct. 20, 2017.
Foreign Communication from a Related Counterpart—International Search Report and Written Opinion, dated Jul. 23, 2018, PCT/US2018/033875, filed on May 22, 2018.
International Preliminary Report on Patentability, dated Dec. 3, 2020, PCT/US2018/033875, filed on May 22, 2018.
International Preliminary Report on Patentability, dated Apr. 30, 2020, PCT/US2017/057674, filed on Oct. 20, 2017.
International Application No. PCT/US2019/065993 filed Dec. 12, 2019, PCT Search Report and Written Opinion dated Apr. 9, 2020.
PCT International Preliminary Report on Patentability dated Jun. 24, 2021; International Application No. PCT/US2019/065993 filed Dec. 12, 2019.
Area 4, "Reboilers", found at: https://www.area4.info/Area4%20Informations/REBOILERS.htm.
Editors: Mokhatab, S.; Poe, W. A. Poe; Spe, J. G. Handbook of Natural Gas Transmission and Processing (Elsevier, 2006, ISBN U 978-0-7506-7776-9, pp. 365-400), Chapter 10, pp. 365-400.
Mak, John, "Flexible NGL Recovery and Methods," filed Oct. 20, 2003, U.S. Appl. No. 60/516,120.
Mak, John, "Ethane Recovery and Ethane Rejection Methods and Configurations," filed Dec. 23, 2010, U.S. Appl. No. 61/426,756.
Mak, John, "Ethane Recovery and Ethane Rejection Methods and Configurations," filed Jan. 21, 2011, U.S. Appl. No. 61/434,887.

(56) References Cited

OTHER PUBLICATIONS

Mak, John, "Configurations and Methods for Retrofitting NGL Recovery Plant," filed Jun. 20, 2011, U.S. Appl. No. 61/499,033.
Mak, John, "Configurations and Methods for NGL Recovery for High Nitrogen Content Feed Gases," filed Sep. 20, 2012, U.S. Appl. No. 61/703,654.
Mak, John, "Flexible NGL Recovery Methods and Configurations," filed Mar. 14, 2013, U.S. Appl. No. 61/785,329.
Mak, John, "Methods and Configuration of an NGL Recovery Process for Low Pressure Rich Feed Gas," filed Feb. 9, 2015, U.S. Appl. No. 62/113,938.
Mak, John, et al., "Methods and Configuration for Retrofitting NGL Plant for High Ethane Recovery." filed Sep. 9, 2016, U.S. Appl. No. 62/385,748.
Mak, John, et al., "Methods and Configuration for Retrofitting NGL Plant for High Ethane Recovery." filed Sep. 9, 2016, U.S. Appl. No. 62/489,234.
U.S. Appl. No. 12/669,025, Office Action, mailed May 8, 2012, 12 pages.
U.S. Appl. No. 12/669,025, Office Action, mailed Oct. 10, 2013, 11 pages.
U.S. Appl. No. 12/669,025, Final Office Action, mailed Mar. 4, 2014, 10 pages.
U.S. Appl. No. 12/669,025, Notice of Allowance, mailed Apr. 7, 2015, 12 pages.
Mexico Patent Application No. MX/a/2010/001472, Office Action, dated Nov. 15, 2013, 1 page.
Mexico Patent Application No. MX/a/2010/001472, Office Action, dated Jul. 23, 2014, 1 page.
United Arab Emirates Patent Application No. 0143/2010, Search Report, dated Oct. 3, 2015, 9 pages.
Restriction Requirement dated Sep. 22, 2015, U.S. Appl. No. 13/996,805, filed Sep. 17, 2013.
Office Action dated Feb. 9, 2016, U.S. Appl. No. 13/996,805, filed Sep. 17, 2013.
Notice of Allowance dated Jun. 9, 2016, U.S. Appl. No. 13/996,805, filed Sep. 17, 2013.
Australian Application No. 2011349713, Examination Report, dated Dec. 16, 2014, 2 pages.
Australia Application No. 2011349713, Notice of Acceptance, dated Mar. 31, 2015, 2 pages.
Restriction Requirement dated Sep. 12, 2018, U.S. Appl. No. 15/259,354, filed Sep. 8, 2016.
Office Action dated Mar. 1, 2019, U.S. Appl. No. 15/259,354, filed Sep. 8, 2016.
Notice of Allowance dated Jun. 19, 2019, U.S. Appl. No. 15/259,354, filed Sep. 8, 2016.
Corrected Notice of Allowability dated Jul. 2, 2019, U.S. Appl. No. 15/259,354, filed Sep. 8, 2016.
Restriction Requirement dated Jan. 8, 2014, U.S. Appl. No. 13/528,332, filed Jun. 20, 2012.
Notice of Allowance dated Aug. 15, 2014, U.S. Appl. No. 13/528,332, filed Jun. 20, 2012.
Examination Report dated Mar. 17, 2016, AU Application No. 2012273028, priority date Jun. 20, 2011.
Office Action dated Jun. 28, 2018, CA Application No. 2,839,132, filed on Dec. 11, 2013.
Office Action dated Jun. 14, 2019, Canadian Application No. 2,839,132, filed on Dec. 11, 2013.
Office Action dated Jun. 29, 2018, MX Application No. MX/A/2013/014864, filed on Dec. 13, 2013.
Notice of Allowance dated Oct. 18, 2018, MX Application No. MX/A/2013/014864, filed on Dec. 13, 2013.
Restriction Requirement dated Nov. 19, 2015, U.S. Appl. No. 14/033,096, filed Sep. 20, 2013.
Office Action dated Jun. 2, 2016, U.S. Appl. No. 14/033,096, filed Sep. 20, 2013.
Final Office Action dated Dec. 9, 2016, U.S. Appl. No. 14/033,096, filed Sep. 20, 2013.
Advisory Action dated Feb. 28, 2017, U.S. Appl. No. 14/033,096, filed Sep. 20, 2013.
Office Action dated May 11, 2017, U.S. Appl. No. 14/033,096, filed Sep. 20, 2013.
Final Office Action dated Nov. 15, 2017, U.S. Appl. No. 14/033,096, filed Sep. 20, 2013.
Advisory Action dated Feb. 6, 2018, U.S. Appl. No. 14/033,096, filed Sep. 20, 2013.
Office Action dated Mar. 26, 2018, U.S. Appl. No. 14/033,096, filed Sep. 20, 2013.
Final Office Action dated Oct. 17, 2018, U.S. Appl. No. 14/033,096, filed Sep. 20, 2013.
Office Action dated Apr. 4, 2019, U.S. Appl. No. 14/033,096, filed Sep. 20, 2013.
Restriction Requirement dated Aug. 9, 2021, filed Jan. 29, 2019, U.S. Appl. No. 16/260,288.
Office Action dated Nov. 25, 2015, U.S. Appl. No. 14/210,061, filed Mar. 14, 2014.
Notice of Allowance dated Mar. 26, 2016, U.S. Appl. No. 14/210,061, filed Mar. 14, 2014.
Notice of Decision dated Sep. 30, 2019, United Arab Emirates Patent Application No. P1023/2015 filed Mar. 14, 2014.
Office Action dated Sep. 26, 2017, U.S. Appl. No. 15/019,570, filed Feb. 6, 2016.
Notice of Allowance dated May 18, 2018, U.S. Appl. No. 15/019,570, filed Feb. 6, 2016.
Office Action dated Mar. 21, 2019, Canadian Patent Application No. 2976071 filed Feb. 9, 2016.
Office Action dated Dec. 3, 2019, Canadian Patent Application No. 2976071 filed Feb. 9, 2016.
Notice of Allowance dated May 19, 2020, Canadian Patent Application No. 2976071 filed Feb. 9, 2016.
Extended European Search Report dated Aug. 1, 2018, European Patent Application filed Feb. 9, 2016.
Communication Pursuant to Rules 70(2) and 70a(2) EPC dated Aug. 20, 2018, European Patent Application filed Feb. 9, 2016.
Examination Report dated Jul. 9, 2020, European Patent Application No. 167497733.9 filed Feb. 9, 2016.
Office Action dated Jul. 7, 2017, U.S. Appl. No. 15/158,143, filed May 16, 2016.
Final Office Action dated Nov. 1, 2017, U.S. Appl. No. 15/158,143, filed May 16, 2016.
Office Action dated Mar. 14, 2018, U.S. Appl. No. 15/158,143, filed May 16, 2016.
Final Office Action dated Jun. 29, 2018, U.S. Appl. No. 15/158,143, filed May 16, 2016.
Office Action dated Oct. 4, 2018, U.S. Appl. No. 15/158,143, filed May 16, 2016.
Notice of Financial Consideration of Grants dated Sep. 19, 2022, Saudi Arabian Patent Application No. 51891931 filed Jan. 15, 2016.
Office Action dated Aug. 19, 2022, Canadian Patent Application No. 3084911 filed Jun. 20, 2012.
Office Action dated Aug. 24, 2022, Argentine Patent Application No. 20190101360 filed May 22, 2019.
Office Action dated Sep. 4, 2022, Saudi Arabian Patent Application No. 520420584 filed May 22, 2018.
Advisory Action dated Sep. 19, 2022, U.S. Appl. No. 16/325,696, filed Feb. 14, 2019.
Advisory Action dated Sep. 1, 2022, U.S. Appl. No. 16/421,138, filed May 23, 2019.
Communication Pursuant to Rule 70(2) and 70a(2) EPC dated Sep. 6, 2022, European Patent Application No. 19895601.3 filed Dec. 12, 2019.
Restriction Requirement dated Aug. 23, 2022, U.S. Appl. No. 17/054,195, filed Nov. 10, 2020.
Office Action dated Dec. 20, 2021, Canadian Patent Application No. 3084911 filed Jun. 20, 2012.
Advisory Action dated Nov. 16, 2021, U.S. Appl. No. 16/219,126, filed Dec. 13, 2018.
Pre-Brief Appeal Decision dated Oct. 20, 2022, U.S. Appl. No. 16/260,288, filed Jan. 29, 2019.
Examiner's Answer dated Jan. 18, 2023, U.S. Appl. No. 16/260,288, filed Jan. 29, 2019.

(56) References Cited

OTHER PUBLICATIONS

Notice of Acceptance dated Oct. 27, 2022, Australian Patent Application filed May 18, 2016.
Notice of Allowance dated Nov. 15, 2022, Canadian Patent Application No. 3022085 filed May 18, 2016.
Office Action dated Nov. 1, 2022, Brazilian Patent Application filed Sep. 8, 2017.
Restriction Required dated Oct. 26, 2021, U.S. Appl. No. 16/325,696, filed Feb. 14, 2019.
Pre-Appeal Brief Decision dated Nov. 18, 2022, U.S. Appl. No. 16/325,696, filed Feb. 14, 2019.
Notice of Allowance dated Nov. 18, 2022, U.S. Appl. No. 16/325,696, filed Feb. 14, 2019.
Notice of Allowance dated Nov. 17, 2022, Canadian Patent Application No. 3047703 filed Feb. 9, 2017.
Notice of Grant dated Dec. 27, 2022, Saudi Arabia Patent Application No. 520411793 filed Oct. 20, 2017.
Office Action dated Oct. 27, 2022, U.S. Appl. No. 17/054,195, filed Nov. 10, 2020.
Examiner's Answer to Appeal Brief dated Feb. 14, 2023, U.S. Appl. No. 16/421,138, filed May 23, 2019.
Restriction Requirement dated May 12, 2017, U.S. Appl. No. 14/988,388, filed Jan. 5, 2016.
Office Action dated Aug. 10, 2017, U.S. Appl. No. 14/988,388, filed Jan. 5, 2016.
Final Office Action dated Nov. 29, 2017, U.S. Appl. No. 14/988,388, filed Jan. 5, 2016.
Notice of Allowance dated Feb. 16, 2018, U.S. Appl. No. 14/988,388, filed Jan. 5, 2016.
Office Action dated Dec. 9, 2019, U.S. Appl. No. 15/988,310, filed May 24, 2018.
Notice of Allowance dated Mar. 13, 2020, U.S. Appl. No. 15/988,310, filed May 24, 2018.
Office Action dated Feb. 24, 2021, Canadian Patent Application No. 3008229 filed Jan. 15, 2016.
European Patent Application No. 16884122.9, Communication pursuant to Rules 161 and 162 EPC, mailed Aug. 20, 2018, 3 pages.
Extended European Search Report dated Aug. 8, 2019, European Patent Application No. 16884122.9.
Communication Pursuant to Rules 70(2) and 70a(2) EPC dated Aug. 27, 2019, European Patent Application No. 16884122.9.
Office Action dated Apr. 13, 2021, Saudi Arabian Patent Application No. 51891931 filed Jan. 15, 2016.
U.S. Appl. No. 10/469,456, Office Action, mailed Sep. 19, 2005, 6 pages.
U.S. Appl. No. 10/469,456, Notice of Allowance, mailed Jan. 10, 2006, 6 pages.
Europe Patent Application No. 02731911.0, Supplementary European Search Report, mailed Nov. 24, 2005, 3 pages.
Europe Patent Application No. 02731911.0, Examination Report, mailed Mar. 2, 2006, 5 pages.
Europe Patent Application No. 02731911.0, Examination Report, mailed Sep. 19, 2006, 4 pages.
Europe Patent Application No. 02731911.0, Intention to Grant, mailed Aug. 1, 2007, 20 pages.
Europe Patent Application No. 02731911.0, Decision to Grant, mailed Dec. 13, 2007, 2 pages.
Canada Patent Application No. 2484085, Examination Report, mailed Jan. 16, 2007, 3 pages.
First Office Action dated Dec. 14, 2007, CN Application No. 200480039552.8 filed Oct. 30, 2003.
Second Office Action dated Nov. 7, 2008, CN Application No. 200480039552.8 filed Oct. 30, 2003.
Notice of Decision to Grant dated Jul. 31, 2009, CN Application No. 200480039552.8 filed Oct. 30, 2003.
Examination Report dated Dec. 19, 2012, EP Application No. 04794213.1 filed Oct. 4, 2004.
Second Examination Report dated Oct. 7, 2014, EP Application No. 04794213.1, filed Oct. 4, 2004.
Office Action dated Jan. 7, 2009, JP Application No. 2006538016, priority date Oct. 30, 2003.
Decision to Grant dated Aug. 20, 2010, JP Application No. 2006538016, priority date Oct. 30, 2003.
Office Action dated Aug. 4, 2010, U.S. Appl. No. 10/595,528, filed Feb. 28, 2007.
Final Office Action dated Dec. 29, 2010, U.S. Appl. No. 10/595,528, filed Feb. 28, 2007.
Advisory Action dated Apr. 14, 2011, U.S. Appl. No. 10/595,528, filed Feb. 28, 2007.
Office Action dated Jun. 8, 2011, U.S. Appl. No. 10/595,528, filed Feb. 28, 2007.
Final Office Action dated Oct. 27, 2011, U.S. Appl. No. 10/595,528, filed Feb. 28, 2007.
Notice of Allowance dated Mar. 5, 2012, U.S. Appl. No. 10/595,528, filed Feb. 28, 2007.
Europe Patent Application No. 08795331.1, Communication pursuant to Rules 161 and 162 EPC, mailed Mar. 24, 2010, 2 pages.
China Patent Application No. 200880103754.2, First Office Action, dated Mar. 27, 2012, 20 pages.
China Patent Application No. 200880103754.2, Second Office Action, dated Dec. 26, 2012, 21 pages.
China Patent Application No. 200880103754.2, Third Office Action, dated Jul. 22, 2013, 7 pages.
China Patent Application No. 200880103754.2, Notification to Grant Patent Right for Invention, dated Dec. 23, 2013, 2 pages.
Australia Patent Application No. 2008287322, First Examination Report, dated Apr. 8, 2011, 2 pages.
Australia Patent Application No. 2008287322, Notice of Acceptance, dated Apr. 4, 2012, 1 page.
Gulf Cooperation Council Patent Application No. GCC/P/2008/11533, Examination Report, dated Dec. 19, 2013, 4 pages.
Canada Patent Application No. 2694149, Office Action, dated Apr. 16, 2012, 2 pages.
Restriction Required dated Oct. 26, 2021, U.S. Appl. No. 15/325,696, filed Feb. 14, 2019.
Office Action dated Sep. 9, 2021, Mexican Patent Application No. MX/a/2016/009162 filed Jul. 13, 2016.
Office Action dated Jul. 29, 2021, Canadian Patent Application No. 3084911 filed Jun. 20, 2012.
Notice of Allowance dated Sep. 6, 2021, Canadian Patent Application No. 3008229 filed Jan. 15, 2016.
Office Action dated Nov. 4, 2021, U.S. Appl. No. 16/390,687, filed Apr. 22, 2019.
Office Action dated Nov. 5, 2021, filed Jan. 29, 2019, U.S. Appl. No. 16/260,288.
Notice of Acceptance dated Jun. 6, 2023, Brazilian Patent Application filed Sep. 8, 2017.
Office Action dated Oct. 19, 2023, Canadian Patent Application No. 3033088 filed Feb. 5, 2019.
Office Action dated Aug. 29, 2023, Mexican Application No. MX/a/2019/001888, filed Feb. 15, 2019.
Notice of Allowance dated Jan. 19, 2024, Mexican Application No. MX/a/2019/001888, filed Feb. 15, 2019.
Office Action dated Jan. 16, 2024, U.S. Appl. No. 18/348,557, filed Jul. 7, 2023.
Office Action dated Oct. 30, 2023, Canadian Patent Application No. 3077409 filed Oct. 20, 2017.
Final Office Action dated Mar. 3, 2023, U.S. Appl. No. 17/054,195, filed Nov. 10, 2020.
Examiner's Answer dated Nov. 8, 2023, U.S. Appl. No. 17/054,195, filed Nov. 10, 2020.
Office Action dated Nov. 16, 2023, Canadian Patent Application No. 3,122,425 filed Oct. 20, 2017.
Appeal Board Decision dated Jul. 1, 2024, U.S. Appl. No. 16/260,288, filed Jan. 29, 2019.
Notice of Allowance dated Feb. 20, 2024, Canadian Patent Application No. 3033088 filed Feb. 5, 2019.
Notice of Allowance dated Feb. 26, 2024, Canadian Patent Application No. 3077409 filed Oct. 20, 2017.
Appeal Board Decision dated Mar. 21, 2024, U.S. Appl. No. 16/219,126, filed Dec. 13, 2018.

(56) References Cited

OTHER PUBLICATIONS

Notice of Allowance dated Apr. 19, 2024, U.S. Appl. No. 16/219,126, filed Dec. 13, 2018.
Appeal Board Decision dated Jun. 24, 2024, U.S. Appl. No. 16/421,138, filed May 23, 2019.

PHASE IMPLEMENTATION OF NATURAL GAS LIQUID RECOVERY PLANTS

CROSS-REFERENCE TO RELATED APPLICATIONS

This applications claims priority to and is a divisional of U.S. patent application Ser. No. 15/789,463 filed on Oct. 20, 2017 to Mak, entitled "Phase Implementation of Natural Gas Liquid Recovery Plants," which is incorporated herein by reference it its entirety.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Natural gas liquids (NGL) may describe heavier gaseous hydrocarbons: ethane (C2H6), propane (C3H8), normal butane (n-C4H10), isobutane (i-C4H10), pentanes, and even higher molecular weight hydrocarbons, when processed and purified into finished by-products. Systems can be used to recover NGL from a feed gas using natural gas liquids plants.

SUMMARY

In an embodiment, a natural gas liquid plant may be configured to operate in either ethane rejection or ethane recovery and may comprise an absorber configured to produce an ethane rich bottom stream and an ethane depleted vapor stream; a stripper fluidly coupled to the absorber configured to, during ethane rejection, fractionate the ethane rich bottom stream from the absorber into an ethane overhead product and a propane plus hydrocarbons product, and configured to, during ethane recovery, fractionate the ethane rich bottom stream into an ethane plus NGL stream and an overhead vapor stream; and an expander configured to, during ethane recovery, expand a vapor portion of a feed gas to the plant, and feed the expanded stream to the absorber.

In an embodiment, a method for operating a natural gas liquid plant in ethane recovery may comprise expanding a vapor portion of a feed gas to the plant to produce a chilled stream; feeding the chilled stream to an absorber; heating, by the exchanger, a vapor stream from the absorber; feeding the cooled ethane rich bottom stream to a stripper; and fractionating, by the stripper, the cooled ethane rich bottom stream into an ethane plus natural gas liquid stream and an overhead vapor stream.

In an embodiment, a method for operating an ethane rejection natural gas liquid plant in an ethane recovery mode may comprise fluidly coupling an expander to an absorber of the plant; expanding, by the expander, a vapor portion of a feed gas to the plant to produce a chilled stream; feeding the chilled stream to the absorber; fluidly coupling an exchanger to the absorber; cooling, by the exchanger, an ethane rich bottom stream from the absorber; heating, by the exchanger, a vapor stream from the absorber; feeding the cooled ethane rich bottom stream to a stripper; and producing, by the stripper, an ethane plus natural gas liquid stream.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1:
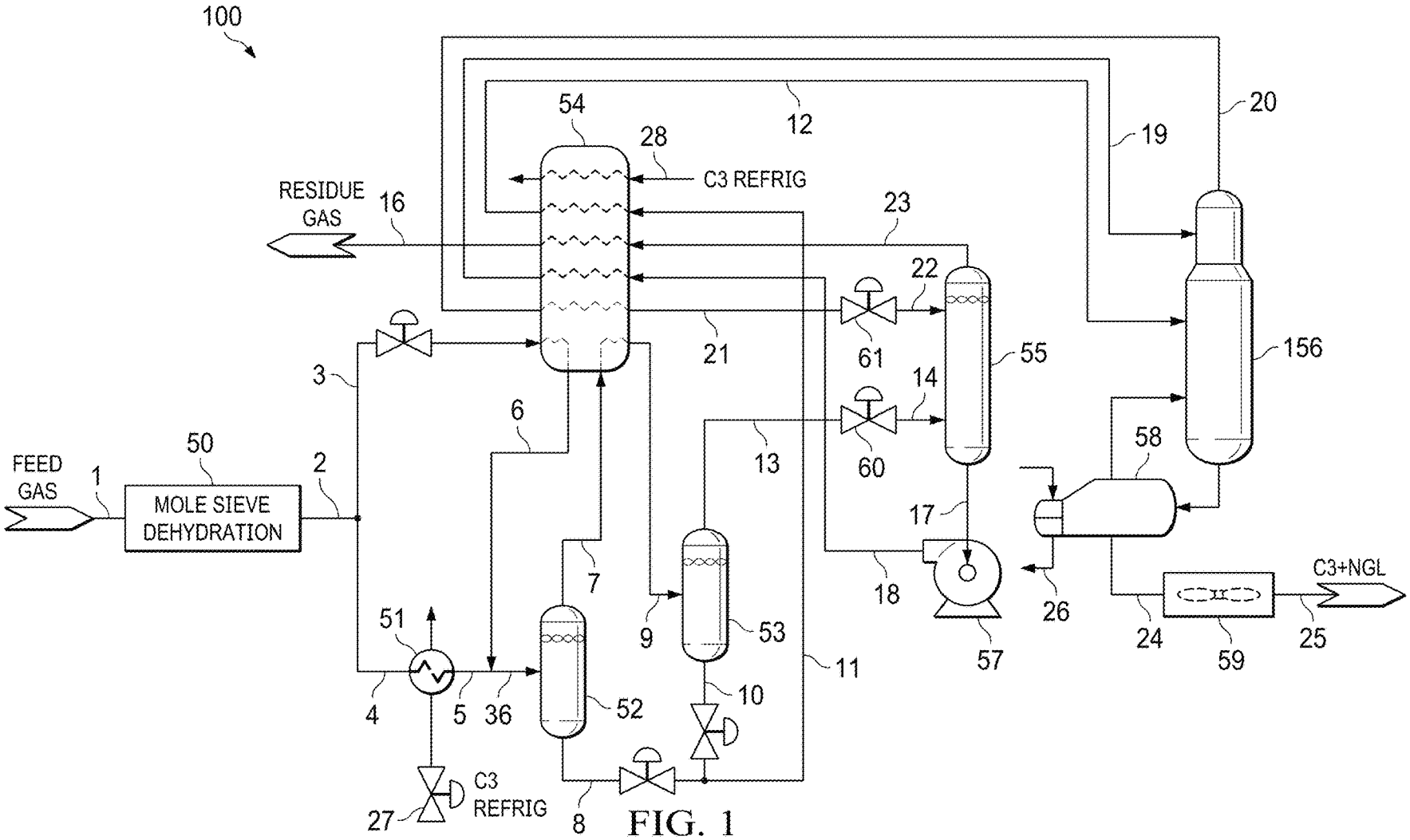
FIG. 1 is a schematic diagram of one exemplary NGL recovery method for ethane rejection according to the inventive subject matter.

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

The following brief definition of terms shall apply throughout the application:

- The term "comprising" means including but not limited to, and should be interpreted in the manner it is typically used in the patent context;
- The phrases "in one embodiment," "according to one embodiment," and the like generally mean that the particular feature, structure, or characteristic following the phrase may be included in at least one embodiment of the present invention, and may be included in more than one embodiment of the present invention (importantly, such phrases do not necessarily refer to the same embodiment);
- If the specification describes something as "exemplary" or an "example," it should be understood that refers to a non-exclusive example;
- The terms "about" or "approximately" or the like, when used with a number, may mean that specific number, or alternatively, a range in proximity to the specific number, as understood by persons of skill in the art field; and
- If the specification states a component or feature "may," "can," "could," "should," "would," "preferably," "possibly," "typically," "optionally," "for example," "often," or "might" (or other such language) be included or have a characteristic, that particular component or feature is not required to be included or to have the characteristic. Such component or feature may be optionally included in some embodiments, or it may be excluded.

All references to percentages of flow refer to volumetric percentages unless otherwise indicated.

Most natural gas plants are designed to condition the feed gas to meet the pipeline sales gas specification, for example including heating value specification, hydrocarbon dew point, and water content. Typically, natural gas plants can be used to extract the propane plus components. However, when the feed gas contains a higher amount of ethane, extraction of propane may not be sufficient due to the high heating value of the feed gas, which is mainly due to the presence of ethane.

Typically, the main revenue from the gas plant operation is generated from sales of the condensate components, including propane, butanes, pentanes, and heavier hydrocarbons. Therefore, typical gas plants may be configured to maximize propane recovery. In the past, the ethane content in the feed gas was valued only for its heating content, and there were no significant incentives for ethane recovery. However, with increasing demand from petrochemical facilities to use ethane as a feedstock, ethane may be more valuable if recovered. Considering this market potential, many natural gas liquids (NGL) recovery plants may be designed for propane recovery with the provision (or option) of converting the propane recovery plant to high ethane recovery in the future.

Additionally, typical gas fields may contain excessive amount of ethane (13% and higher) such that a propane recovery plant would fail to meet the heating value requirement (1200 Btu/scf) of the sales gas, which would require propane recovery plants to operate in ethane recovery, resulting in lower propane recovery.

Numerous separation processes and configurations are known in the art to fractionate the NGL fractions from natural gas. In a typical gas separation process, a high pressure feed gas stream may be cooled by heat exchangers, using propane refrigeration and turbo expansion, and the extent of cooling may depend on the hydrocarbon contents and desired levels of recoveries. As the feed gas is cooled under pressure, the hydrocarbon liquids may be condensed and separated from the cooled gas. The cooled vapor is expanded and fractionated in distillation columns (e.g. a deethanizer and/or a demethanizer) to produce (1) a residue gas containing mainly methane gas to a sales gas pipeline and (2) an ethane plus bottom that is to be transported by pipeline to a distant petrochemical facility.

Typically, current natural gas plants process relatively lean gases with ethane content less than 10%. While typical gas plants may be acceptable for a feed gas with a lower ethane content, they may not be suitable if the ethane content feed gas is high.

Typical natural gas liquid plants may be configured for either high ethane recovery or high propane recovery, and typically the ethane recovery process will decrease propane recovery to below 90% if operated on ethane rejection. For example, Rambo et al. describe in U.S. Pat. No. 5,890,378 a system in which the absorber is refluxed, in which the deethanizer condenser provides refluxes for both the absorber and the deethanizer while the cooling duties are supplied by turbo-expansion and propane refrigeration. Here, the absorber and the deethanizer operate at essentially the same pressure. Although Rambo's configuration can recover 98% of the C3+ hydrocarbons during propane recovery operation, high ethane recovery (e.g. over 80%) is difficult even with additional refluxes. The other problem is to maintain high propane recovery (e.g. over 95%) when the NGL plant is required to operate under an ethane rejection mode. The rejected ethane will contain a significant amount of propane, which typically lowers the overall propane recovery to below 90%.

To circumvent at least some of the problems associated with low ethane recoveries, Sorensen describes in U.S. Pat. No. 5,953,935 a plant configuration in which an additional fractionation column and reflux condenser are added to increase ethane recovery using cooling with turbo expansion and Joule Thompson expansion valves of portions of the feed gas. Although Sorensen's configuration may achieve high ethane recoveries, it fails to achieve high propane recovery when operated on ethane rejection. In addition, the ethane plus NGL product must be re-fractionated in a deethanizer to meet the liquefied petroleum gas (LPG) vapor pressure specification, subsequently increasing the overall energy consumption.

In yet other known configurations, high NGL recoveries were attempted with various improved fractionation and reflux configurations. Typical examples are shown in U.S. Pat. Nos. 4,278,457, and 4,854,955, to Campbell et al., in U.S. Pat. No. 6,244,070 to Lee et al., and in U.S. Pat. No. 5,890,377 to Foglietta. While such configurations may provide at least some advantages over prior processes, they are generally intended to operate on a definite recovery mode, either ethane recovery or propane recovery. Moreover, most of such known configurations require extensive modifications of turbo expanders and piping routing when the plants are retrofitted from propane recovery to ethane recovery or vice versa. In most cases, the capital and operating cost for the retrofit processes are relatively high and the revenue losses due to facility shutdown for installation are also high, making the operational change uneconomical.

To circumvent at least some of the problems associated with high ethane recovery while maintaining a high propane recovery, a twin reflux process (described in U.S. Pat. No. 7,051,553 to Mak et al.) employs configurations in which a first column receives two reflux streams: one reflux stream comprising a vapor portion of the NGL and the other reflux stream comprising a lean reflux provided by the overhead of the second distillation column. Similarly, U.S. Pat. App. No. 2010/0206003 to Mak et al. describes an improved natural gas liquid recovery method in which residue gas is integrated to the propane recovery design such that it can be used to reflux the demethanizer during high ethane recovery. However, even with these improvements, high ethane recovery (over 90%) is typically not feasible with additional reflux streams. All publications herein are incorporated by reference to the same extent as if each individual publication or patent application were specifically and individually indicated to be incorporated by reference. Where a definition or use of a term in an incorporated reference is inconsistent or contrary to the definition of that term provided herein, the definition of that term provided herein applies and the definition of that term in the reference does not apply.

Thus, although various configurations and methods are known to recover natural gas liquids, they typically suffer from one or more disadvantages. For example, while some known methods and configurations can be employed for ethane recovery and propane recovery, ethane rejection will typically result in a loss in propane recovery. Another drawback to the previously described systems is complexity of these systems, making them difficult to operate when changing ethane modes are required. Therefore, there is a need to provide methods and configurations for an NGL recovery plant that can recover high propane recovery of over 95% during ethane rejection, and can be modified to operate on ethane recovery of over 95% producing a pure ethane product for the petrochemical plants.

Embodiments of the disclosure relate to natural gas liquids plants as well as phase implementation of natural gas liquids plants from ethane rejection or high propane recovery to high ethane recovery. Systems and methods disclosed herein relate to processing natural gas, especially as it relates to the methods of configuring a natural gas liquid (NGL) plant for fully rejecting ethane and changing the configuration (e.g. retrofitting) of the NGL plant for over 95% ethane recovery, while maintaining high propane recovery.

The present invention is directed to methods and configurations of a phase implementation of a propane recovery plant (ethane rejection) to ethane recovery without (substantial) losses in propane recovery, where the plant may comprise an absorber and a stripper that are closely coupled with a feed gas/residue gas/refrigeration reflux system.

When the system is operating in ethane rejection, the contemplated methods and systems may produce an ethane rich sales gas and a propane plus NGL product stream, and during ethane recovery, the methods and systems may produce a lean gas to sales and a Y-grade NGL product stream to a downstream facility.

In some embodiments, a dried feed gas may be split into two portions at the inlet of the NGL plant battery limit, with a first portion at about 30% to 60% of the feed gas, where the first portion may be chilled and partially condensed and separated, forming a first liquid, while a vapor is further chilled to a lower temperature and separated, forming a second liquid, with the combined liquids let down in pressure and fed to the feed exchanger.

When the system is operating in ethane rejection, the stripper overhead may be partially condensed in the feed exchanger, forming a reflux that may be fed as reflux to the absorber. The feed exchanger may comprise at least six cores, which may include one or more of refrigerant liquid, separator liquids, absorber overhead, absorber bottom, fractionator overhead, and/or feed gas.

When the system is operating in ethane rejection, the stripper may fractionate the ethane rich NGL from the absorber into an ethane overhead product and a propane plus hydrocarbons product. The methods and systems described here may be configured to achieve over 95% propane recovery, while rejecting 98% of the ethane content from the NGL.

Also, when the system is operating in ethane recovery, a turbo expander and/or an absorber (bottom) exchanger may be added to the system to provide more chilling to the system, such that the NGL plants provide ethane recovery of at least 95% and propane plus recovery of at least 98%.

Disclosed embodiments of an NGL recovery plant may comprise an absorber and a stripper (which may function as a deethanizer/demethanizer) fluidly coupled, and the plant may be changed from ethane rejection to ethane recovery or vice versa with minor process adjustment. The same equipment and piping can be used for both operations and no retrofit may be required to meet the minimum 95% ethane and high propane recovery (for example, if the plant is built to this embodiment configuration, where pre-existing plants may also be retrofit towards this embodiment configuration).

It should be recognized that the disclosed plant may be used to condition the feed gas to meet the sales gas heating value specification and ethane recovery targets in ethane recovery operation.

The feed gas to the system can be a variable feed gas with variable hydrocarbons content and ethane content and is supplied at a temperature of about 100° F. and a pressure of about 900 psig. As used herein, the term "about" in conjunction with a numeral refers to that numeral +/−10, inclusive. For example, where a temperature is "about 100° F.", a temperature range of 90–110° F., inclusive, is contemplated.

Referring now to FIG. 1, an exemplary NGL plant 100 may comprise two columns, such as an absorber 55 and a stripper 156, where one column (e.g. the stripper 156) may serve as a deethanizer 156 during ethane rejection and as a demethanizer 256 (described in FIG. 2) during ethane recovery.

In one exemplary configuration as depicted in FIG. 1, an NGL recovery plant 100 may comprise a first column (absorber) 55 that is fluidly coupled to a second column (deethanizer) 156. The plant 100 as shown in FIG. 1 may operate in "ethane rejection" as described above. As an example, the feed gas stream 1 may be dried in molecular sieve unit 50, forming a dried gas stream 2, which may enter the plant battery limit. The dried gas stream 2 may be split into two portions, stream 3 and stream 4, in a ratio of about 30 to 60% of the feed gas flow. The ratio may be dependent on the richness of the feed gas, and the ratio may be increased to provide more flow to a propane chiller 51 when the richness of the feed gas increases. Stream 3 may be chilled in a feed exchanger 54, forming stream 6, while stream 4 may be chilled in the propane chiller 51 using a refrigerant stream 27, forming stream 5, where stream 5 may be mixed with stream 6, forming combined stream 36. The feed exchanger 54 may be operated using a refrigerant stream 28.

Stream 36 may be separated in a separator 52 into a vapor stream 7 and a liquid stream 8. Vapor stream 7 may be further chilled in the feed exchanger 54, forming stream 9, which may then be separated in a separator 53 into vapor stream 13 and liquid stream 10. Liquid stream 10 may be letdown in pressure and combined with the letdown liquid stream 8, forming a further chilled stream 11, where stream 11 may be fed to the feed exchanger 54 to be heated, forming stream 12. Stream 12 may be fed to the mid-section of the deethanizer 156. The recovery of the refrigeration from the letdown stream enhances the operating efficiency of the process.

Stream 13 may be letdown in pressure in JT valve 60 forming stream 14, where stream 14 may be fed to the absorber 55. Absorber 55 may produce an ethane rich bottom liquid stream 17 and a propane depleted vapor stream 23. The propane depleted vapor stream 23 may be heated in the feed exchanger 54 to produce residue gas stream 16. Bottom liquid stream 17 may be pumped by pump 57, forming stream 18, which may be about 100 psi higher than the absorber pressure. Stream 18 may be chilled in feed exchanger 54, forming stream 19 which may be fed as reflux to the deethanizer 156.

During the ethane rejection operation (as shown in FIG. 1), the second column acts as a deethanizer 156 and may operate at a higher pressure than the absorber 55, fractionating the absorber bottom (stream 19) and the separator liquid (stream 12) into a propane plus NGL stream 24 and an overhead vapor stream 20. The overhead vapor stream 20 may be chilled in the feed exchanger 54 forming chilled stripper vapor stream 21. The chilled stripper vapor stream 21 may be letdown in pressure via a JT valve 61 and chilled, forming stream 22, which may be fed to the absorber 55 as reflux. A heat medium stream 26 (for example, hot oil or steam) may be used to supply the bottom duty to exchanger 58, maintaining the ethane content in the propane plus NGL stream 24 to below 1 to 2 volume %. The stripper bottom propane plus NGL stream 24 may be further cooled in air cooler 59, forming stream 25 as the NGL product.

As an example of suitable conditions of the process shown in FIG. 1, Stream 3 may be chilled in the feed exchanger 54 to about 0° F., forming stream 6. Vapor stream 7 may be chilled in the feed exchanger 54, forming stream 9 at about −40° F. Liquid stream 10 may be combined with liquid stream 8, forming stream 11 operating at −55° F., where stream 11 may be fed to the feed exchanger 54 to be heated to about 0° F., forming stream 12. Stream 13 may be letdown in pressure in JT valve 60 to about 300 psia and chilled to about −60° F., forming stream 14, where stream 14 may be fed to the absorber 55. Absorber 55 may produce an ethane rich bottom liquid stream 17, at about −75° F. Stream 18 may be chilled in feed exchanger 54 to about −40° F., forming stream 19. The chilled stripper vapor stream 21 may be letdown in pressure via a JT valve 61 and chilled to about −75° F., forming stream 22. During the ethane rejection operation (as shown in FIG. 1), the second column (or deethanizer) 156 may operate at about 50 to 100 psi higher pressure than the absorber 55.

Figure 3:
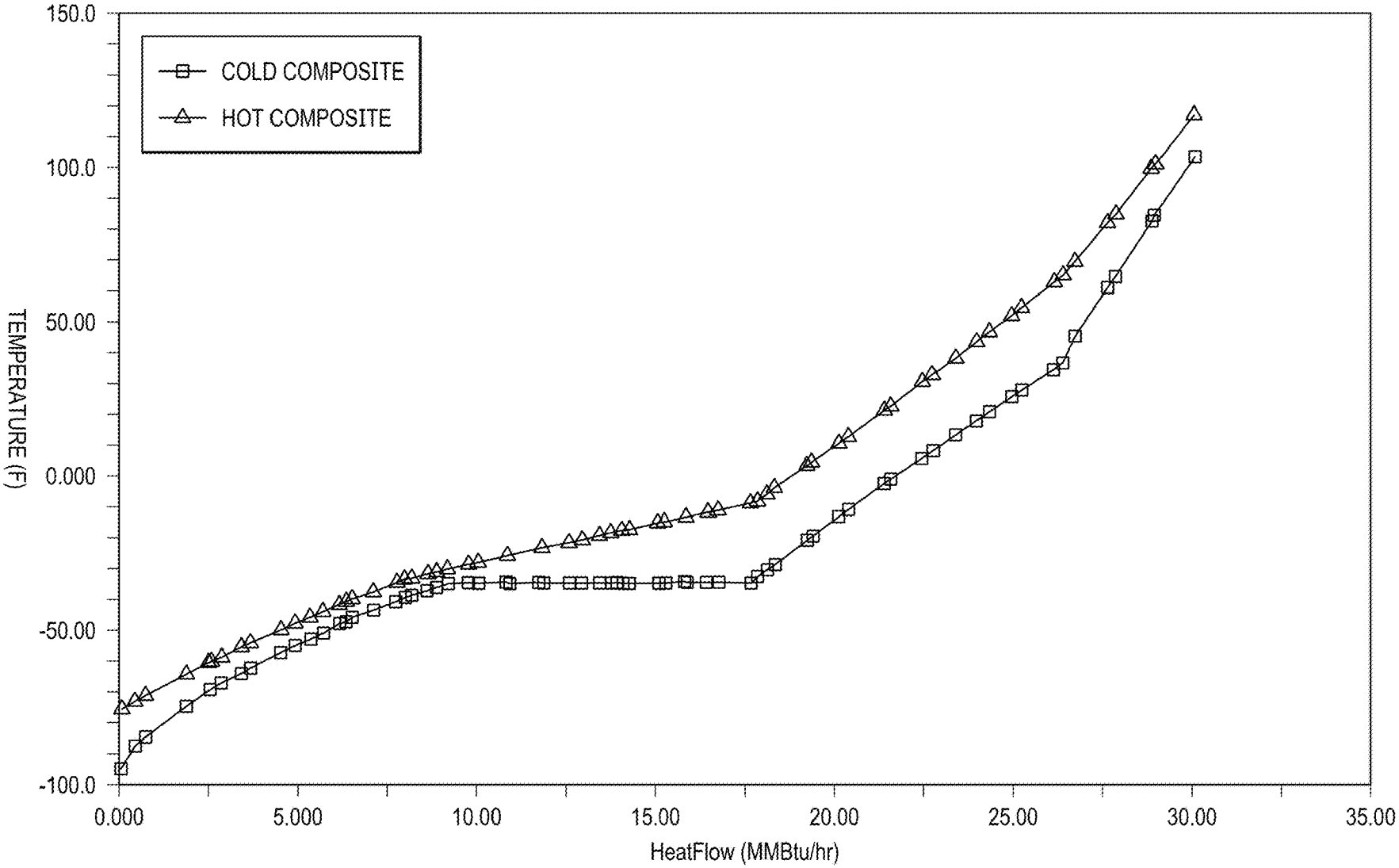
FIG. 3 is a heat recovery curve composite diagram for ethane rejection according to the inventive subject matter.

The heat recovery efficiency of the ethane rejection process (described above in FIG. 1) is shown in heat composite curve in FIG. 3, and the overall heat and material balance table is shown below in Table 1.

TABLE 1

Heat and material balance for ethane rejection

| Description Component | Dry Gas Mole % | C3 + NGL Mole % | Sale Gas Mole % |
|---|---|---|---|
| Nitrogen | 1.22 | 0.00 | 1.39 |
| CO2 | 0.00 | 0.00 | 0.00 |
| Methane | 73.83 | 0.00 | 83.90 |
| Ethane | 13.22 | 3.26 | 14.58 |
| Propane | 8.25 | 67.81 | 0.13 |
| i-Butane | 0.68 | 5.67 | 0.00 |
| n-Butane | 2.10 | 17.51 | 0.00 |
| i-Pentane | 0.27 | 2.25 | 0.00 |
| n-Pentane | 0.32 | 2.67 | 0.00 |
| Hexane+ | 0.10 | 0.83 | 0.00 |
| H2S | 0.00 | 0.00 | 0.00 |
| H2O | 0.00 | 0.00 | 0.00 |
| Total | 100.00 | 100.00 | 100.00 |
| Molar Flow (lb mole/h) | 6,588.3 | 790.3 | 5,798.1 |
| Temperature (° F.) | 118.0 | 110.0 | 104.0 |
| Pressure (psia) | 915.0 | 368.0 | 295.0 |

Figure 2:
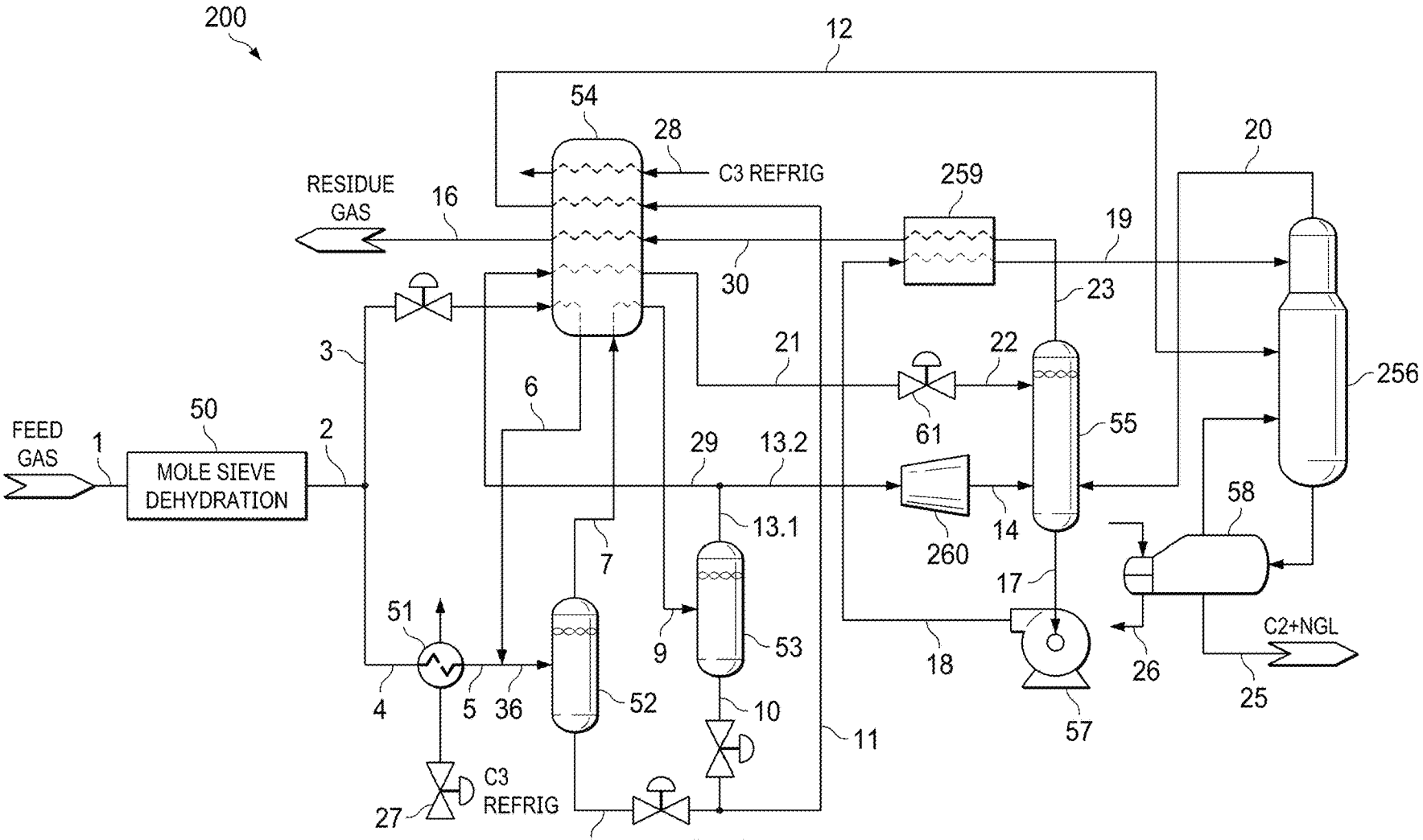
FIG. 2 is a schematic diagram of another exemplary NGL recovery method for ethane recovery according to the inventive subject matter.

In another exemplary embodiment, as depicted in FIG. 2, an NGL recovery plant 200 can operate in ethane recovery mode, capable of (at least) 95% ethane recovery and higher while maintaining high propane recovery (e.g. 99% or at least 95%). During this operation, the stripper (or second column) may operate as a demethanizer 256 (instead of acting as a deethanizer, as in FIG. 1) producing the ethane plus NGL (stream 25). The plant 200 may be similar to the plant 100 as described in FIG. 1, with minor changes in piping routing, and possibly with some elements operating at a lower temperature profile, where only the new parts of the plant 200 are described below. The remaining portions of the plant of FIG. 2 can be the same as or similar to those described with respect to the elements shown in FIG. 1, and the description of those elements is hereby repeated.

The additional equipment required for the ethane recovery operation (shown in FIG. 2) may include an expander 260 and/or an exchanger 259 (with FIG. 2 showing an embodiment/configuration with both). The expander 260 may provide a refrigeration stream 14 to the absorber 55, allowing the system to operate at a lower temperature, and the exchanger 259 may (optionally) allow the absorber bottom liquid (stream 17) to the demethanizer 256 to operate at a lower temperature (for example, at about −120 to −130° F.). With the expander operating, the outlet stream 14 may drop in temperature to about −120° F. and may be at a similar pressure to the stream 14 described above in FIG. 1 (i.e. about 300 psia). Preferably, in ethane recovery operation (shown in FIG. 2), the plant would have both the expander 260 and the exchanger 259. The use of the exchanger 259 in combination with the expander 260 may allow the plant to effectively process a range of feed stream compositions.

The front section of the ethane recovery process may be the same as the ethane rejection case (as described in FIG. 1). The feed stream 13.2 to the expander 260 may come from the vapor stream 13.1 of the separator 53, wherein stream 13.1 may be split into stream 13.2 (to the expander) and stream 29 (to the feed exchanger 54). Stream 13.2 may be controlled to about 40 to 60% of the feed gas stream 1 (by flow rate) and may be chilled to about −115° F. The remaining flow, stream 29, may be routed to and chilled by the feed exchanger 54, supplying the reflux stream 22 to the absorber 55 (as described above in FIG. 1). With these changes, the absorber 55 can operate at lower temperatures, producing an absorber overhead ethane depleted vapor stream 23 (which may be similar to the propane depleted vapor stream 23 described in FIG. 1, but with at least a portion of the ethane removed from the stream 23) at about −155° F. and a bottom liquid stream 17 at about −120° F.

During operation of the plant 200 for ethane recovery, the demethanizer 256 is configured to fractionate the absorber bottom stream 19 into an ethane plus NGL stream 25 and an overhead vapor stream 20. The overhead vapor stream 20 may be fed to the bottom of the absorber 55 for reabsorption of the ethane content (as opposed to being heated and returned to the absorber 55 as reflux, as in FIG. 1). The ethane plus NGL stream 25 may contain about 1 mole % methane content, meeting the required specification for Y-grade NGL.

As described above, the absorber 55 may produce an ethane rich bottom liquid stream 17 and an ethane depleted vapor stream 23. The bottom liquid stream 17 may be pumped by pump 57, forming stream 18, which may be about 10 to 20 psi higher than the absorber pressure, as needed to feed the demethanizer 256 downstream. To further improve ethane recovery, stream 18 may be fed to the exchanger 259 and chilled to form stream 19, which is then fed to the demethanizer 256. The vapor stream 23 from the absorber 55 may also be fed to the exchanger 259 and heated to form stream 30, which is then further heated in the feed exchanger 54, producing the residue gas stream 16. Alternatively, the absorber bottom stream 18 can be fed directly to the demethanizer 256 (however ethane recovery may not be as effective with this configuration, i.e. ethane recovery may be reduced by about 1 to 2%).

Figure 4:
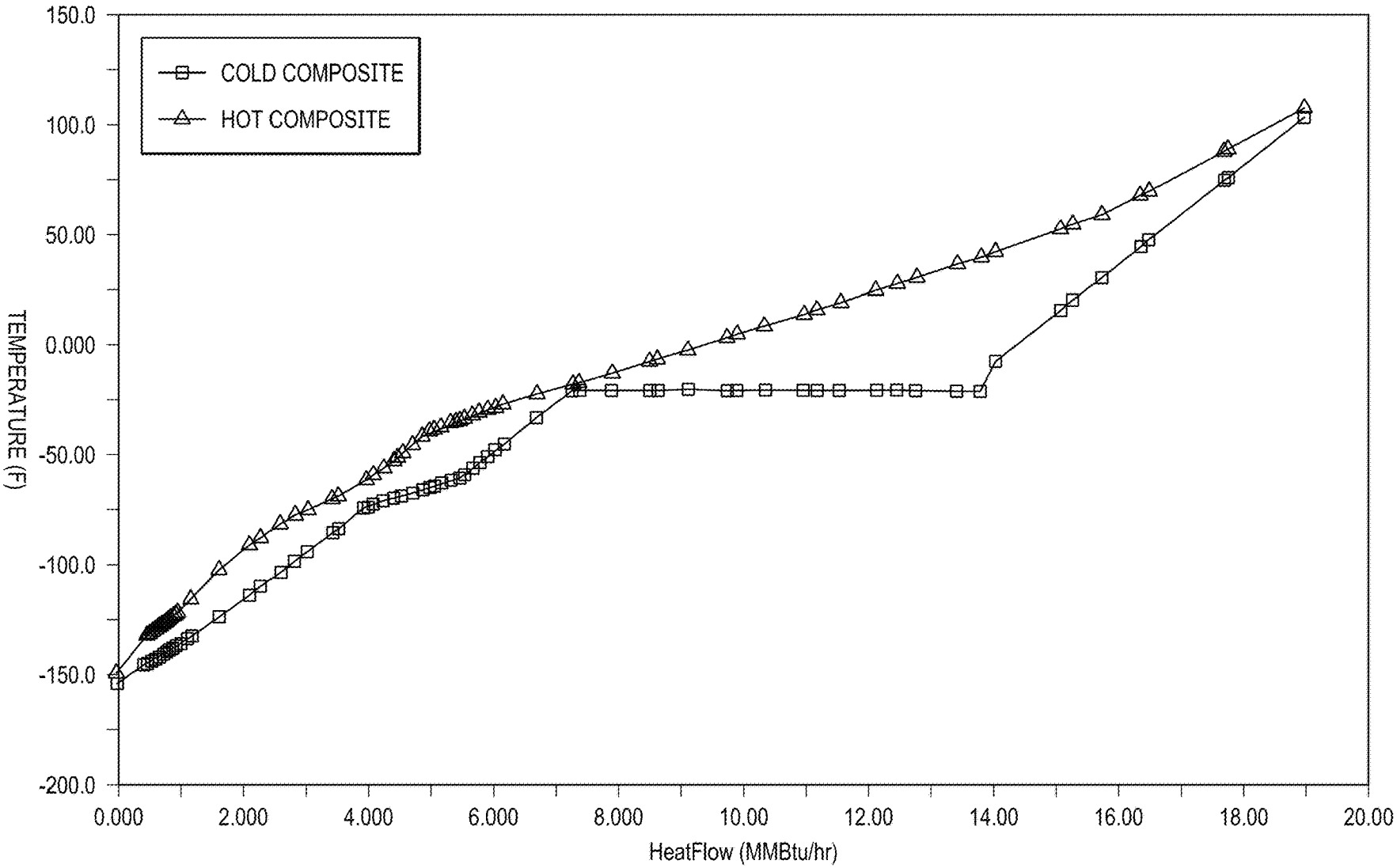
FIG. 4 is a heat recovery curve composite diagram for ethane recovery according to the inventive subject matter.

The heat recovery efficiency of the ethane recovery process is shown in heat composite curve in FIG. 4, and the overall heat and material balance table is shown below in Table 2.

TABLE 2

Heat and material balance for ethane recovery

| Description Component | Dry Gas Mole % | C2 + NGL Mole % | Sale Gas Mole % |
|---|---|---|---|
| Nitrogen | 1.22 | 0.00 | 1.66 |
| CO2 | 0.00 | 0.00 | 0.00 |
| Methane | 73.83 | 1.17 | 97.60 |
| Ethane | 13.22 | 49.72 | 0.70 |
| Propane | 8.25 | 35.72 | 0.03 |
| i-Butane | 0.68 | 3.00 | 0.00 |
| n-Butane | 2.10 | 7.95 | 0.00 |
| i-Pentane | 0.27 | 0.90 | 0.00 |
| n-Pentane | 0.32 | 0.97 | 0.00 |
| Hexane+ | 0.10 | 0.53 | 0.00 |

TABLE 2-continued

| Heat and material balance for ethane recovery | | | |
|---|---|---|---|
| Description<br>Component | Dry Gas<br>Mole % | C2 + NGL<br>Mole % | Sale Gas<br>Mole % |
| H2S | 0.00 | 0.00 | 0.00 |
| H2O | 0.00 | 0.00 | 0.00 |
| Total | 100.00 | 100.00 | 100.00 |
| Molar Flow (lb mole/h) | 6588.3 | 1544.2 | 5043.5 |
| Temperature (° F.) | 118.0 | 67.7 | 104.0 |
| Pressure (psia) | 915.0 | 305.0 | 302.0 |

With respect to suitable feed gas streams, it is contemplated that different feed gas streams are acceptable, and especially feed gas streams may contain a high level of ethane and heavier hydrocarbon content. With respect to the gas compositions, it is generally preferred that the feed gas stream predominantly includes C1-C6 hydrocarbons and nitrogen and other inert compounds (but may exclude $CO_2$ due to potential freeze issues). The contemplated preferred feed gas streams are associated and non-associated gas from oil and gas production units.

Thus, specific embodiments and applications for improved natural gas liquids recovery have been disclosed. It should be apparent, however, to those skilled in the art that many more modifications besides those already described are possible without departing from the inventive concepts herein. The inventive subject matter, therefore, is not to be restricted except in the spirit of the present disclosure. Moreover, in interpreting the specification and contemplated claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Furthermore, where a definition or use of a term in a reference, which is incorporated by reference herein is inconsistent or contrary to the definition of that term provided herein, the definition of that term provided herein applies and the definition of that term in the reference does not apply.

Having described various devices and methods herein, exemplary embodiments or aspects can include, but are not limited to:

In a first embodiment, a natural gas liquid plant configured to operate in either ethane rejection or ethane recovery may comprise an absorber configured to produce an ethane rich bottom stream and a propane depleted vapor stream; a stripper fluidly coupled to the absorber configured to, during ethane rejection, fractionate the ethane rich bottom stream from the absorber into an ethane overhead product and a propane plus hydrocarbons product, and configured to, during ethane recovery, fractionate the ethane rich bottom stream into an ethane plus NGL stream and an overhead vapor stream; and an expander configured to, during ethane recovery, expand a vapor portion of a feed gas to the plant, and feed the expanded stream to the absorber.

A second embodiment can include the plant of the first embodiment, further comprising an exchanger configured to, during ethane recovery, counter-currently contact the ethane rich bottom stream from the absorber with the ethane depleted vapor stream from the absorber, thereby heating the vapor stream and chilling the ethane rich bottom stream before the ethane rich bottom stream is fed to the stripper.

A third embodiment can include the plant of the first or second embodiments, wherein the expanded vapor stream from the expander to the absorber provide increased chilling to the absorber when compared with the plant during ethane rejection.

A fourth embodiment can include the plant of any of the first to third embodiments, wherein the chilled ethane rich bottom stream that is fed to the stripper provides increased chilling to the stripper when compared with the plant during ethane rejection.

A fifth embodiment can include the plant of any of the first to fourth embodiments, wherein, during ethane recovery, the overhead vapor stream from the stripper is fed to the bottom of the absorber for reabsorption of the ethane content.

A sixth embodiment can include the plant of any of the first to fifth embodiments, wherein, during ethane recovery, the ethane plus natural gas liquids stream (from the stripper) contains about 1 mole % methane content.

A seventh embodiment can include the plant of the sixth embodiment, wherein during ethane rejection, the stripper functions as a deethanizer.

An eighth embodiment can include the plant of any of the first to seventh embodiments, wherein during ethane recovery, the stripper functions as a demethanizer.

A ninth embodiment can include the plant of any of the first to eighth embodiments, wherein the plant produces at least 95% (or at least about 95%) propane recovery during ethane rejection.

A tenth embodiment can include the plant of any of the first to ninth embodiments, wherein the plant produces at least 95% (or 99%, at least 99%, or about 99%) propane recovery during ethane recovery.

In an eleventh embodiment, a method for operating a natural gas liquid plant in ethane recovery may comprise expanding a vapor portion of a feed gas to the plant to produce a chilled stream; feeding the chilled stream to the absorber; heating, by the exchanger, a vapor stream from the absorber; feeding the cooled ethane rich bottom stream to a stripper; and fractionating, by the stripper, the cooled ethane rich bottom stream into an ethane plus natural gas liquid stream and an overhead vapor stream.

A twelfth embodiment can include the method of the eleventh embodiment, further comprising cooling, by an exchanger, a bottom stream from an absorber, wherein the bottom stream comprises an ethane rich bottom stream.

A thirteenth embodiment can include the method of the eleventh or twelfth embodiments, wherein, during ethane recovery, the absorber operates at a lower temperature than when the plant is operated in ethane rejection.

A fourteenth embodiment can include the method of any of the eleventh to thirteenth embodiments, wherein, during ethane recovery, the ethane plus natural gas liquids stream (from the stripper) contains about 1 mole % methane content.

A fifteenth embodiment can include the method of any of the eleventh to fourteenth embodiments, further comprising feeding the overhead vapor stream from the stripper to the bottom of the absorber for reabsorption of the ethane content.

In a sixteenth embodiment, a method for operating an ethane rejection natural gas liquid plant in an ethane recovery mode may comprise fluidly coupling an expander to an absorber of the plant; expanding, by the expander, a vapor portion of a feed gas to the plant to produce a chilled stream; feeding the chilled stream to the absorber; fluidly coupling an exchanger to the absorber; cooling, by the exchanger, an ethane rich bottom stream from the absorber; heating, by the exchanger, a vapor stream from the absorber; feeding the cooled ethane rich bottom stream to a stripper; and producing, by the stripper, an ethane plus natural gas liquid stream.

A seventeenth embodiment can include the method of the sixteenth embodiment, wherein, during ethane recovery, the absorber operates at a lower temperature than during ethane rejection.

An eighteenth embodiment can include the method of the sixteenth or seventeenth embodiments, further comprising producing, by the stripper, an overhead vapor stream, and feeding the overhead vapor stream from the stripper to the bottom of the absorber for reabsorption of the ethane content.

A nineteenth embodiment can include the method of any of the sixteenth to eighteenth embodiments, wherein, during ethane recovery, the ethane plus natural gas liquids stream (from the stripper) contains about 1 mole % methane content.

A twentieth embodiment can include the method of any of the sixteenth to nineteenth embodiments, wherein the plant produces at least 95% propane recovery during ethane recovery.

While various embodiments in accordance with the principles disclosed herein have been shown and described above, modifications thereof may be made by one skilled in the art without departing from the spirit and the teachings of the disclosure. The embodiments described herein are representative only and are not intended to be limiting. Many variations, combinations, and modifications are possible and are within the scope of the disclosure. Alternative embodiments that result from combining, integrating, and/or omitting features of the embodiment(s) are also within the scope of the disclosure. Accordingly, the scope of protection is not limited by the description set out above, but is defined by the claims which follow that scope including all equivalents of the subject matter of the claims. Each and every claim is incorporated as further disclosure into the specification and the claims are embodiment(s) of the present invention(s). Furthermore, any advantages and features described above may relate to specific embodiments, but shall not limit the application of such issued claims to processes and structures accomplishing any or all of the above advantages or having any or all of the above features.

Additionally, the section headings used herein are provided for consistency with the suggestions under 37 C.F.R. 1.77 or to otherwise provide organizational cues. These headings shall not limit or characterize the invention(s) set out in any claims that may issue from this disclosure. Specifically and by way of example, although the headings might refer to a "Field," the claims should not be limited by the language chosen under this heading to describe the so-called field. Further, a description of a technology in the "Background" is not to be construed as an admission that certain technology is prior art to any invention(s) in this disclosure. Neither is the "Summary" to be considered as a limiting characterization of the invention(s) set forth in issued claims. Furthermore, any reference in this disclosure to "invention" in the singular should not be used to argue that there is only a single point of novelty in this disclosure. Multiple inventions may be set forth according to the limitations of the multiple claims issuing from this disclosure, and such claims accordingly define the invention(s), and their equivalents, that are protected thereby. In all instances, the scope of the claims shall be considered on their own merits in light of this disclosure, but should not be constrained by the headings set forth herein.

Use of broader terms such as "comprises," "includes," and "having" should be understood to provide support for narrower terms such as "consisting of," "consisting essentially of," and "comprised substantially of" Use of the terms "optionally," "may," "might," "possibly," and the like with respect to any element of an embodiment means that the element is not required, or alternatively, the element is required, both alternatives being within the scope of the embodiment(s). Also, references to examples are merely provided for illustrative purposes, and are not intended to be exclusive.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. A natural gas liquid plant configured to operate in either an ethane rejection mode or an ethane recovery mode, the plant comprising:

an absorber;

a stripper;

a feed exchanger;

an expander; and one or more separators;

a plurality of associated connections, wherein each of the plurality of the associated connections is configured to provide a route of fluid communication between two or more of the absorber, the stripper, the feed exchanger, the expander, and the one or more separators;

wherein in the ethane rejection mode:

the plurality of the associated connections is configured such that a first portion of a feed stream forms a first stripper feed stream that is passed from the one or more separators to the stripper;

the plurality of the associated connections is configured such that a second portion of the feed stream forms a first absorber feed stream that is passed from the one or more separators to the absorber;

the absorber is configured to produce an absorber bottom stream and an absorber overhead stream, wherein the absorber overhead stream forms a residue gas;

the plurality of the associated connections is configured such that the absorber bottom stream is passed from the absorber to the feed exchanger;

the stripper is configured to produce a stripper bottom natural gas liquid product stream and a stripper overhead stream;

the plurality of the associated connections is configured such that the stripper overhead stream is passed from the stripper to the feed exchanger, and the feed exchanger receives the stripper overhead stream and chills the stripper overhead stream;

the plurality of the associated connections is configured such that the feed exchanger receives the absorber bottom stream and chills the absorber bottom stream;

the plurality of the associated connections is configured such that the absorber bottom stream is passed from the feed exchanger to the stripper; and the plurality of the associated connections is configured such that the stripper overhead stream is passed from the feed exchanger to the absorber as a second absorber feed stream; and wherein in the ethane recovery mode:

the plurality of the associated connections is configured such that the first portion of the feed stream forms the first stripper feed stream that is passed to the stripper;

the plurality of the associated connections is configured such that the second portion of the feed stream forms the first absorber feed stream that is passed to the absorber;

the plurality of the associated connections is configured such that a third portion of the feed stream is passed to the expander;

the expander is configured to expand the third portion of the feed stream;

the plurality of the associated connections is configured such that the third portion of the feed stream forms a second absorber stream that is passed from the expander to the absorber;

the absorber is configured to produce the absorber bottom stream and the absorber overhead stream, wherein the absorber overhead stream forms the residue gas;

the plurality of the associated connections is configured such that the absorber bottom stream is passed from the absorber to the stripper;

the stripper is configured to produce the stripper bottom natural gas liquid product stream and the stripper overhead stream;

the plurality of the associated connections is configured such that the stripper overhead stream is passed from the stripper to the absorber; and the plurality of the associated connections is configured such that the feed exchanger receives the second portion of the feed stream and chills the second portion of the feed stream, and such that the second portion of the feed stream is passed from the feed exchanger to the absorber.

2. The plant of claim 1, further comprising:

a second exchanger, wherein the second exchanger is configured, in the ethane recovery mode, to receive the absorber bottom stream and chill the absorber bottom stream.

3. The plant of claim 1, wherein, in the ethane rejection mode, the plurality of the associated connections is configured such that the first portion of the feed stream is passed from the one or more separators to a mid-section of the stripper.

4. The plant of claim 1, wherein, in the ethane rejection mode, the plurality of the associated connections is configured such that the absorber bottom stream forms a stripper reflux stream that is passed from the feed exchanger to the stripper.

5. The plant of claim 1, further comprising a Joule Thompson valve, wherein, in the ethane rejection mode:

the plurality of the associated connections is configured such that the stripper overhead stream is received by the Joule Thompson valve from the feed exchanger;

the Joule Thompson valve is configured to reduce a pressure of the stripper overhead stream to form the second absorber feed stream; and the plurality of the associated connections is configured such that the second absorber feed stream is passed from the Joule Thompson valve to the absorber.

6. The plant of claim 5, further comprising a second Joule Thompson valve, wherein, in the ethane rejection mode:

the plurality of the associated connections is configured such that the first absorber feed stream is received by the second Joule Thompson valve;

the second Joule Thompson valve is configured to reduce a pressure of the first absorber feed stream; and the plurality of the associated connections is configured such that the first absorber feed stream is passed from the second Joule Thompson valve to the absorber.

7. The plant of claim 1, wherein, in the ethane rejection mode, the second absorber feed stream enters the absorber above the first absorber feed stream.

8. The plant of claim 1, further comprising a Joule Thompson valve, wherein, in the ethane recovery mode:

the plurality of the associated connections is configured such that the first absorber feed stream is received by the Joule Thompson valve;

the Joule Thompson valve is configured to reduce a pressure of the first absorber feed stream, and the plurality of the associated connections is configured such that the first absorber feed stream is passed from the Joule Thompson valve to the absorber.

9. The plant of claim 1, wherein the plant is configured to recover at least 95% propane in the ethane rejection mode and the ethane recovery mode.

* * * * *